US008657642B2

(12) United States Patent
Magot

(10) Patent No.: US 8,657,642 B2
(45) Date of Patent: Feb. 25, 2014

(54) R/C CAR WITH DEMOLITION FEATURES

(76) Inventor: Jammy Magot, Tokyo (JP)

( * ) Notice: Subject to any disclaimer, the term of this patent is extended or adjusted under 35 U.S.C. 154(b) by 311 days.

(21) Appl. No.: 13/065,754

(22) Filed: Mar. 29, 2011

(65) Prior Publication Data

US 2012/0252313 A1 Oct. 4, 2012

(51) Int. Cl.
*A63H 17/02* (2006.01)
*A63H 30/04* (2006.01)
*A63H 30/00* (2006.01)

(52) U.S. Cl.
USPC ..... 446/454; 446/6

(58) Field of Classification Search
USPC ..... 446/4, 6, 435, 441, 444, 454–457, 470, 446/471, 484, 485
See application file for complete search history.

(56) References Cited

U.S. PATENT DOCUMENTS 2,757,482 A * 8/1956 Brown et al. ..... 446/6
4,911,669 A * 3/1990 Parker ..... 446/6
5,380,231 A * 1/1995 Brovelli ..... 446/6
5,713,783 A * 2/1998 Szoke et al. ..... 446/456
5,816,888 A * 10/1998 Myers ..... 446/456
5,906,528 A * 5/1999 Ostendorff et al. ..... 446/6
6,565,412 B1 * 5/2003 Thrasher ..... 446/465
6,679,752 B1 * 1/2004 Reed, Sr. ..... 446/437
7,607,961 B2 * 10/2009 Lorelli et al. ..... 446/454

* cited by examiner

*Primary Examiner* — Nini Legesse
(74) *Attorney, Agent, or Firm* — Gerald R. Black, Esq.

(57) ABSTRACT

A radio controlled R/C car including, a body supported on a plurality of wheels including at least one drive wheel, a remote control in communication with a controller on the car, a plurality of removable panels each panel including a latch to hold the panel in a first position on the car body and each latch associated with a plunger movable from a first position holding the latch in place to a second position releasing the latch, a first spring biasing the plunger to the first position and a second spring loaded by the latch the second spring biasing the panel away from the first position such that the panel springs away from the car body to simulate a crash. Once all the panels are released a sound plays and a driver ejects from the car and the car stops. Two or more cars can be used in a demolition derby where the last car still running with a driver would be the winner.

20 Claims, 5 Drawing Sheets

R/C CAR WITH DEMOLITION FEATURES

CROSS REFERENCES TO RELATED APPLICATIONS none.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates generally to radio controlled (R/C) cars.

2. Brief Description of Prior Art

There have been many remote controlled cars. Some patents for remote controlled cars reveal features that react to the car experiencing an impact.

U.S. Pat. No. 7,607,961 is an R/C car that has a plurality of panels 58-62 that come off on impact. The performance of the car degrades as impacts occur. This car is very unique but is too complex to manufacture at a reasonable price.

As can be seen, there is a need for an improved R/C car.

SUMMARY OF THE INVENTION

A radio controlled R/C car including, a body supported on a plurality of wheels including at least one drive wheel, a remote control in communication with a controller on the car, a plurality of removable panels each panel including a latch to hold the panel in a first position on the car body and each latch associated with a plunger movable from a first position holding the latch in place to a second position releasing the latch, a first spring biasing the plunger to the first position and a second spring loaded by the latch the second spring biasing the panel away from the first position such that the panel springs away from the car body to simulate a crash. Once all the panels are released a sound plays and a driver ejects from the car and the car stops. Two or more cars can be used in a demolition derby where the last car still running with a driver would be the winner.

DETAILED DESCRIPTION OF THE PREFERRED EMBODIMENT

Figure 1:
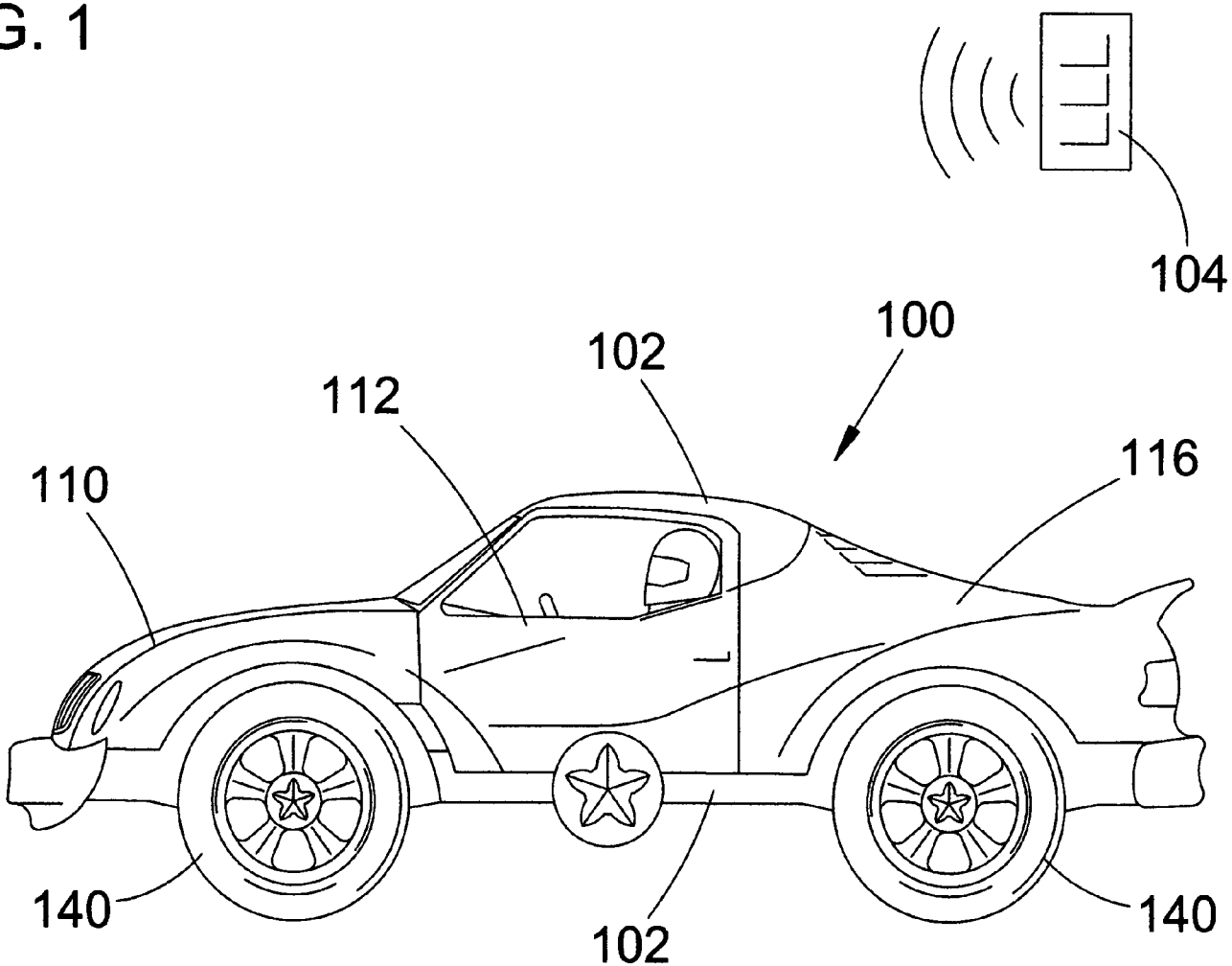
FIG. 1 shows an exterior view of the car.
Figure 4:
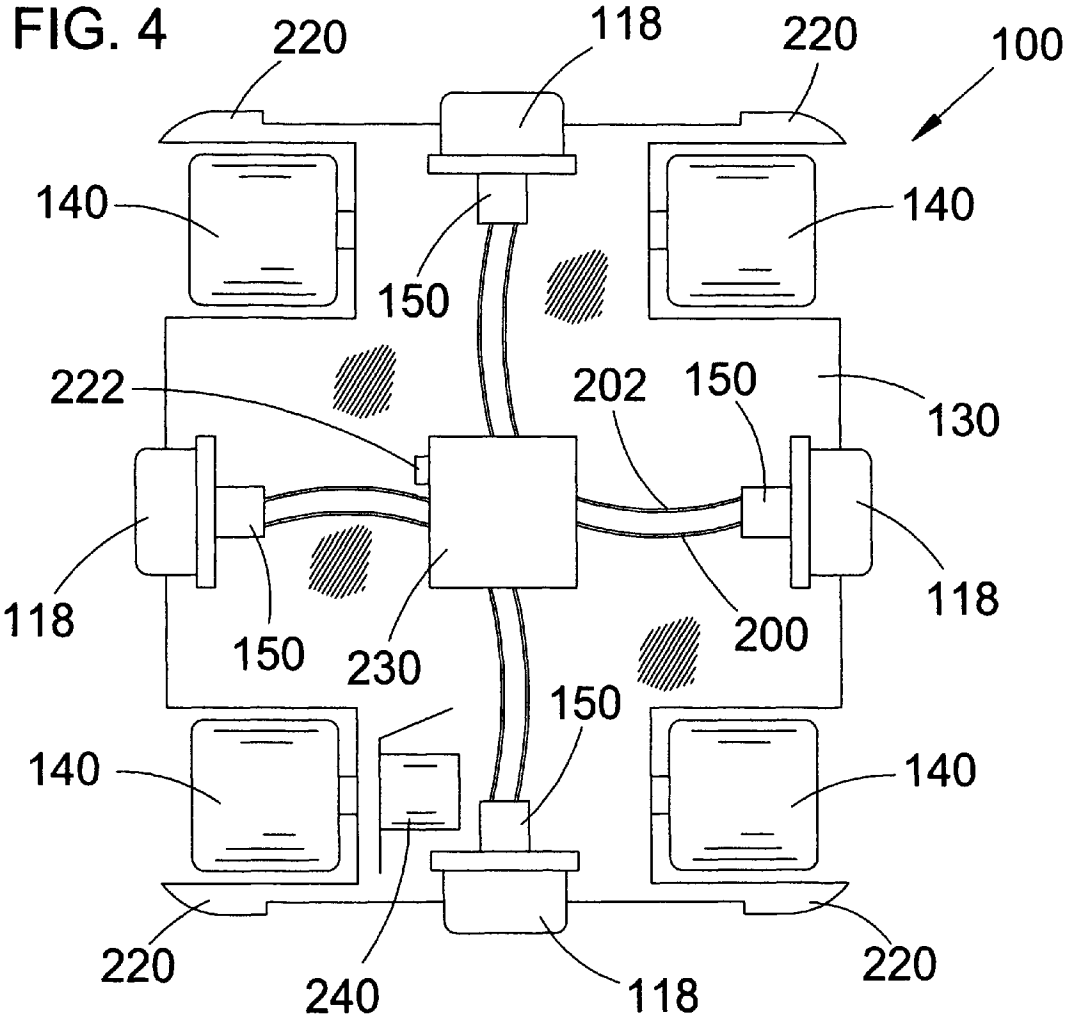
FIG. 4 shows an underneath view of the car of FIG. 1

FIG. 1 shows an R/C car 100. The car 100 includes a molded body 102. The car 100 includes panels that are spring loaded and that pop off the car 100 when impact occurs. The car 100 includes a remote controller 104 and four panels, a hood 110, two doors 112 and 114 and a rear portion 116. There is an activation trigger such as plunger 118 on the driver's side. An impact on the plunger 118 will cause the door 112 to come off. Each panel 110-116 has a plunger 118 that will trigger its release. As seen in FIG. 4 there is a plunger 118 to control each of the four panels 110-116. The remote 104 allows a user to control the car 100 remotely such as remote speed control and remote steering.

Figure 2:
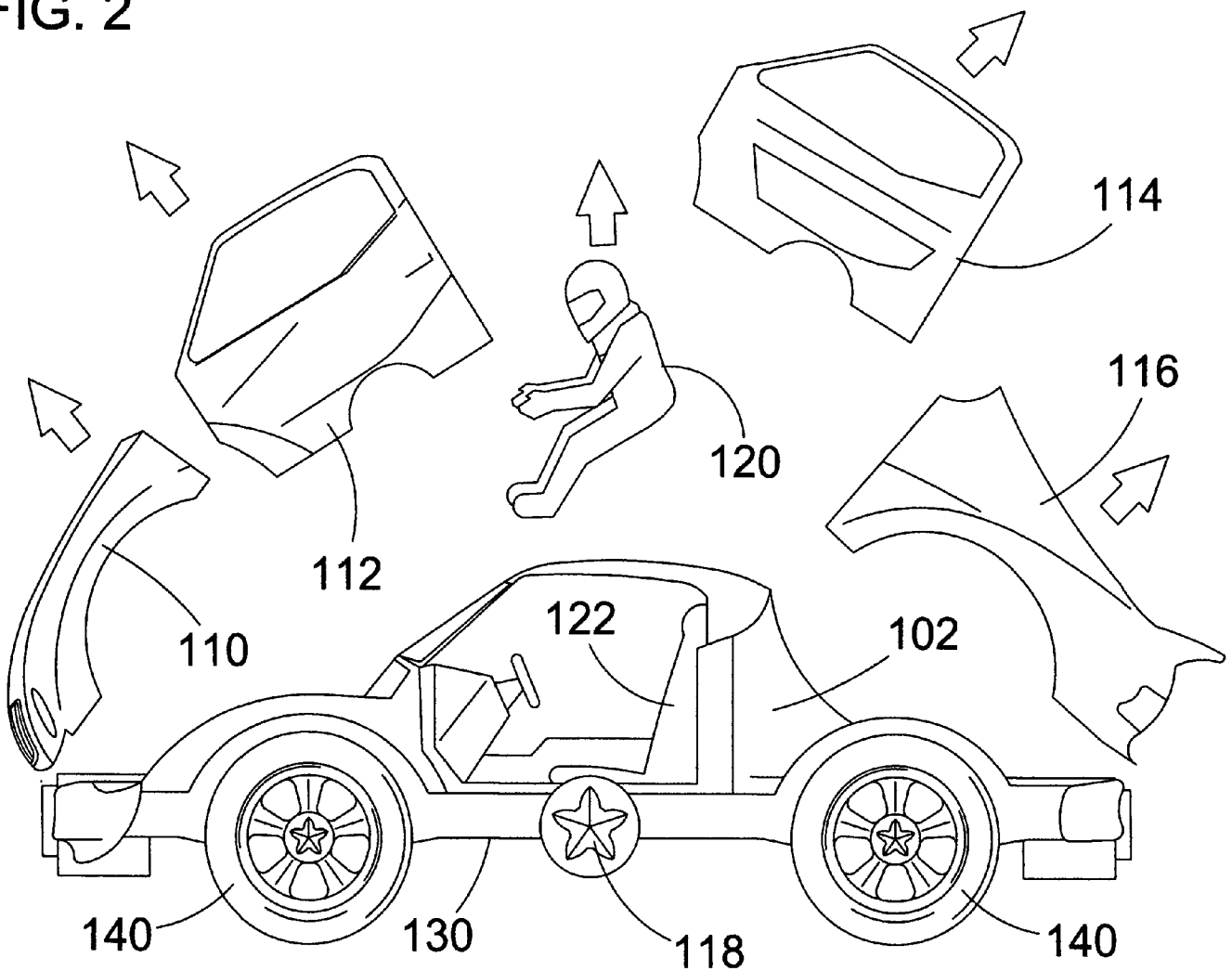
FIG. 2 shows an exploded view of the car of FIG. 1.

FIG. 2 shows the panels 110-116 that come off the car 100.

In use the panels 110-116 come off one at a time as the plunger 118 associated with that panel 110-116 is depressed. For simplicity FIG. 2 shows all panels 110-116 coming off all at once, in use this could only occur if all four plungers 118 were depressed at the same time. FIG. 2 also shows the driver 120 ejecting. A controller (see FIG. 4) senses when all four panels 110-116 are released and then ejects the driver 120. The driver's seat 122 can conceal a spring loaded release not shown. The body 102 includes a lower body 130 to which a plurality of wheels 140 are attached. At least one wheel 140 is a drive wheel powered by a motor 240 see FIG. 4.

Figure 3:
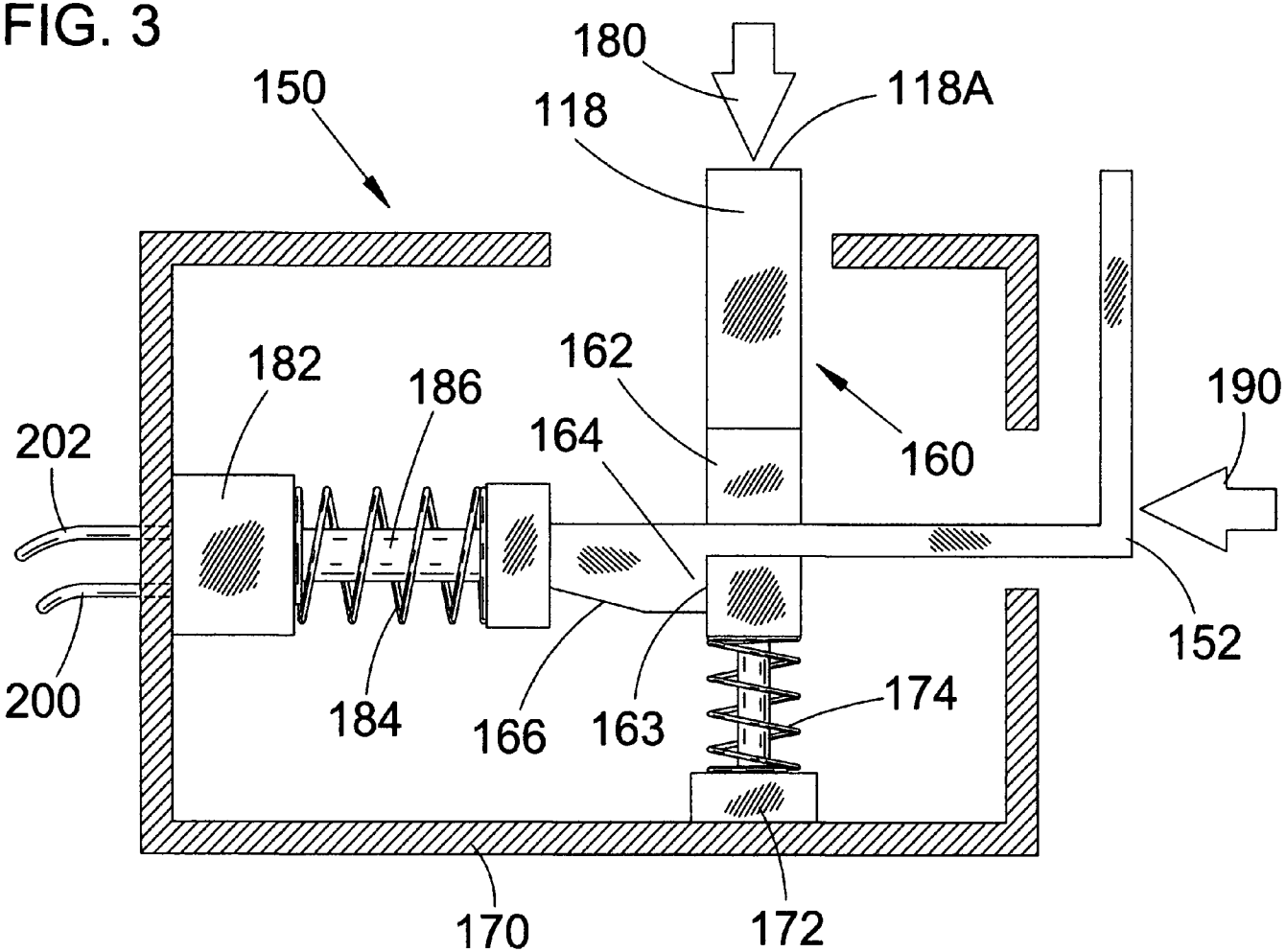
FIG. 3 shows details of the car of FIG. 1.

FIG. 3 shows details of a typical plunger 118 and the spring loaded release 150. Each panel 110-116 includes a latch 152 that is integrally molded with the panel 110-116. The plunger 118 includes an outer portion **118*a* that can be impacted by objects or other cars. The plunger 118 also includes a concealed portion 160 that includes a slot 162 and a surface 163 that engages a projection 164 on the latch 152. The projection 164 includes a cam portion 166. The spring loaded release 150 can include a housing 170 that can be integrally molded with the lower body 130. The housing 170 also includes a support 172 that supports a first spring 174. The first spring 174 holds the plunger 118 in a first position as shown in FIG. 3. Pressure acting on the plunger 118, as represented by arrow 180, will compress the first spring 174. The housing 170 includes a second support 182 that supports a second spring 184. The second spring 184 includes a coaxial rod 186. Movement of the latch 152 toward the support 182 (as shown by arrow 190) will make up an electrical contact in support 182 that will electrically connect wires 200 and 202 such that a controller (FIG. 5) can sense the presence of the latch 152**.

Figure 5:
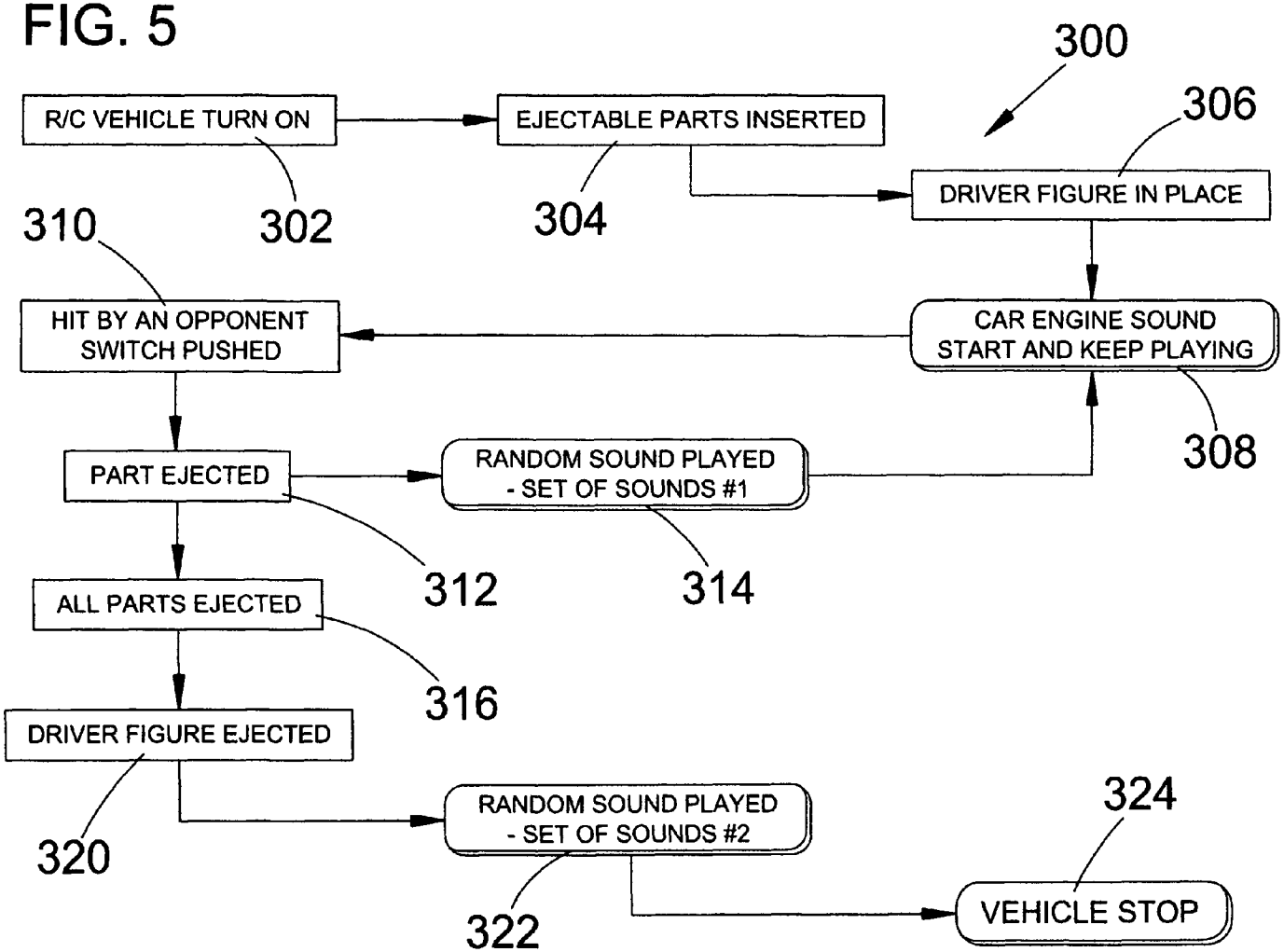
FIG. 5 shows control details of the car.

FIG. 4 shows the R/C car 100 underneath. The molded lower body 130 supports four spring loaded releases 150, one on each side of the car 100. The molded lower body 130 also includes four bumpers 220 placed to trigger the plunger 118 on another car. Each spring loaded release 150 includes a wire pair 200, 202 that connect a contact in the spring loaded release 150 to a controller 230 so that the controller 230 can sense the presence of a panel 110-116. FIG. 5 shows the operation 300 of the controller 230. The car 100 is first turned on 302. Any panels 110-116 that are not connected to the car 100 can be inserted 304. The driver 120 can also be inserted 306. Once the car 100 starts an engine sound will start 308 and keep playing as long as the car 100 runs. When the car 100 is hit in such a way that a plunger 118 is depressed 310 a panel associated with that plunger 118 is released 312 and a sound 314 such as a crash sound, will play. The sound played 314 can be a random sound chosen from a first set of sounds. If after a part is ejected some parts remain on the car 100 the car 100 will continue to operate 308. If all the panels 110-116 are knocked off 316 the car 100 then the driver 120 is ejected 320 and a random sound from a second set of sounds will play 322 and the car 100 will stop 324. In operation the car 100 is turned on with a switch 222 on the controller 230. Each panel 110-116 is placed on the car 100. To place a panel 110-116 on the car 100 the latch 152 is placed into the housing 170 and the cam 166 of projection 164 aligns with slot 162 and pushes the plunger 118 against first spring 174, then the plunger 164 pushes against second spring 184 until the plunger 118 drops into the loaded position shown in FIG. 3 with the plunger surface 163 resting against the projection 164. As can be seen in FIG. 3 if the plunger 118 moves toward support 172 against spring 174 until the surface 163 disengages from projection 164 then the panel latch 152 will be released from the housing 170 under force supplied by the second spring 184 and then user will see one of the panels 110-116 fly off and will hear a random sound from a first set of sounds. The first set of random sounds might include a crash sound or a simulated voice for example. As each panel 110-116 is released a switch in support 182 senses the release with wire pair 200/202 so that the controller 232 knows a panel is released. Once all four panels 110-116 are released a sound from a second set of random sounds plays and the driver 120 is ejected and the car 110 stops. Referring to FIG. 3 it will be understood that once a panel 110-116 is released impacts on that plunger 118 will have no further effect. A game can be played where several cars 100 are running, in the game the last car running will win.

It will be obvious to those skilled in the art that modifications may be made to the embodiments described above without departing from the scope of the invention. Thus the scope of the invention should be determined by the claims in the formal application and their legal equivalents, rather than by the examples given.

I claim:

1. An R/c car including, a body supported on a plurality of wheels including at least one drive wheel, a remote control in communication with a controller on the car, a plurality of removable panels each panel including a latch to hold the panel in a first position on the car body and each latch associated with a plunger movable from a first position holding the latch in place to a second position releasing the latch, a first spring biasing said plunger to said first position and a second spring loaded by said latch said second spring biasing said panel away from said first position such that said panel springs away from said car body.

2. The car of claim 1 wherein said plunger moves from said first position toward said second position upon an impact with said plunger.

3. The car of claim 1 wherein when said car is running an engine sound is played and when said panel springs away from said body a first sound chosen randomly from a first set of sounds plays.

4. The car of claim 1 wherein said car includes four plungers, one on each side of the car and one on the front of the car and one on the back of the car, wherein impact on the front of the car will release a hood panel, impact on a side will release a door panel and impact on the rear will release a trunk panel.

5. The car of claim 1 wherein when all of said plurality of panels have been released from said body a driver will be ejected from said car.

6. The car of claim 1 wherein when all of said plurality of panels are released from said body the car will stop.

7. The car of claim 1 wherein when all of said plurality of panels are released from said body a second sound chosen randomly from a second set of sounds will play.

8. The car of claim 1 wherein the controller senses the release of each panel and plays a first sound upon the release of each panel and wherein the controller senses when all of said plurality of panels has been released and plays a second sound and releases an additional part.

9. An R/c car including, a body supported on a plurality of wheels, at least one drive, a remote control in communication with a controller on the car, a plurality of removable panels each panel including means to hold the panel in a first position on the car body and each panel associated with a plunger movable from a first position holding the panel in place to a second position releasing the panel, a first spring biasing said plunger to said first position and a second spring biasing said panel away from said first position such that said panel springs away from said car body when released.

10. The car of claim 9 wherein said plunger moves from said first position toward said second position upon an impact with said plunger.

11. The car of claim 9 wherein when said car is running an engine sound plays and when said panel springs away from said body a first sound chosen randomly from a first set of sounds plays.

12. The car of claim 9 wherein said car includes four plungers, one on each side of the car and one on the front of the car and one on the back of the car, wherein impact on a plunger will release an associated panel.

13. The car of claim 12 wherein when all of said plurality of panels have been released from said body a driver will be ejected from said car.

14. The car of claim 12 wherein when the driver is released from said body the car will stop.

15. The car of claim 12 wherein when all of said plurality of panels are released from said body a second sound chosen randomly from a second set of sounds will play.

16. An R/c car including, a body supported on a plurality of wheels, at least one drive, a control in communication with a controller on the car, a plurality of removable panels each panel including a latch to hold the panel in a first position on the car body and each panel associated with a plunger movable from a first position holding the panel in place to a second position releasing the panel, a first elastic member biasing said plunger to said first position and a second elastic member biasing said panel away from said first position such that said panel springs away from said car body when released.

17. The car of claim 16 wherein said plunger moves from said first position toward said second position upon an impact with said plunger.

18. The car of claim 17 wherein when all of said plurality of panels have been released from said body a driver will be ejected from said car.

19. The car of claim 18 wherein when said car is running an engine sound plays and when said panel springs away from said body a first sound chosen randomly from a first set of sounds plays.

20. The car of claim 19 wherein when the driver is released from said body the car will stop.

* * * * *